United States Patent [19]

Gillespie et al.

[11] 4,200,944

[45] May 6, 1980

[54] BOW OR KEEL SOLID LIFT ASSEMBLY FOR BOATS

[75] Inventors: Herman L. Gillespie; Harlow E. Baumgartner, both of Fort Wayne, Ind.

[73] Assignee: Lois C. Baumgartner, Fort Wayne, Ind.

[21] Appl. No.: 845,029

[22] Filed: Oct. 25, 1977

[51] Int. Cl.[2] ..... B63B 21/00

[52] U.S. Cl. ..... 9/1.1; 9/1.7; 114/218; 114/230; 403/44

[58] Field of Search ..... 114/230, 218, 249, 251, 114/253, 254; 9/1.1, 1.7, 43–45; 151/41.76, 41.7; 85/32 R, 32 K; 248/58, 291; 403/61, 44

[56] References Cited

U.S. PATENT DOCUMENTS

| | | | |
|---|---|---|---|
| 485,484 | 11/1892 | Arnold | 403/44 |
| 1,275,987 | 8/1918 | McGowan | 9/43 |
| 2,191,613 | 2/1940 | Ericsson | 151/41.7 |

*Primary Examiner*—Sherman D. Basinger
*Attorney, Agent, or Firm*—Albert L. Jeffers

[57] ABSTRACT

A lift assembly which extends through the boat deck to the bow or keel and includes a combination lifting-eye and cleat mounted to the deck, a rigid strap mounted to the bow or keel of the boat having an arcuate closed loop portion with a slot therein extending in the arcuate direction. A cylindrical nut is rotatably received in the loop portion of the strap and a rigid rod extends through the slot and is threadedly secured to the nut, the other end thereof being threadedly connected to the lifting-eye. In the case of a bow mounted strap, the bow-eye, which is in the form of a U-bolt, extends through the bow and a pair of apertures in the strap and is secured thereto by means of nuts which clamp the strap to the bow.

6 Claims, 6 Drawing Figures

BOW OR KEEL SOLID LIFT ASSEMBLY FOR BOATS

BACKGROUND OF THE INVENTION

The present invention relates to lifting assemblies for boats and in particular to lifting assemblies of the type wherein an eye is mounted to the top deck and connected through a tension bearing member to a bow or keel mounted lifting strap.

In order to launch a boat or remove it from the water, it is common practice to hoist it above the water by means of hooks which engage lifting-eyes mounted to the deck of the boat. Because the deck is designed primarily to support loads acting in a downward direction such as, for example, forces exerted by persons walking on the deck, substantial damage would be done to the deck if an upward force were applied thereto, as would be the case if the boat were lifted by means of lifting rings mounted directly to the deck. To overcome this difficulty without foregoing the convenience of a lifting-eye located on the deck, the load is transferred to a heavily reinforced portion of the boat, such as the bow or keel, by means of a rod or chain connected between the deck ring and a bow or keel lifting strap. When the deck ring is pulled, the connecting member is tensioned so that virtually the entire force is transferred to the bow or keel.

One type of prior art lifting assembly comprises a lifting strap adapted to be bolted to the bow or keel of a boat, a solid metal rod pivotally connected at one end thereof to the strap and connected at the other end to a deck mounted lifting-eye. The strap comprises a metal strip bent to comprise a flat portion having a pair of apertures therethrough and a slotted, elongated loop portion. The rod is connected to the lifting strap by means of a T-nut which is slidably and rotatably received in the loop portion and includes an internally threaded socket coaxial with the longitudinal dimension of the nut.

The primary difficulty with this type of device lies in the irregular shape of the T-nut, which is a single casting, and has a substantial number of inherent weak points that enhance crack formation and propagation when the nut is stressed. Obviously, the greatest stress is applied when the boat is lifted so that failure of the nut at this point generally results in the boat being dropped thereby causing substantial damage to the boat and possible injury to nearby persons. The faulty design inherent in this type of nut has resulted in an unacceptably high incidence of such accidents.

Another design deficiency in this assembly lies in the shape of the loop portion of the strap which is elongated and considerably larger than that portion of the T-nut which is contained therein. As the T-nut is pulled against one end of the loop portion during lifting, there is a tendency for the loop to flatten out and elongate so that not all of the lifting forces are transferred to the bow or keel. This results in the deck being pulled upwardly away from the bow and keel with resultant damage since it is not designed to withstand lifting loads.

A further example of prior art lifting assemblies is disclosed in U.S. Pat. No. 3,863,588 to one of the present applicants. It comprises a pair of U-bolts extending through the deck and bow, respectively, and secured thereto by nuts on opposite sides of the deck and bow which clamp escutcheon plates thereagainst. The U-bolts are interconnected by an adjustable tension element, which may be a chain or strap, connected at opposite ends to eye-bolts which in turn are secured to the deck and bow U-bolts. The drawbacks to this type of device include stretching and flexing of the chain or strap and off-center twisting forces being applied to the lifting-eyes, especially the bow mounted eye.

SUMMARY OF THE INVENTION

The present invention overcomes the disadvantages of the prior art discussed above by providing a symmetrical nut, which is cylindrical in shape, and therefore is free of structural weak points and faults inherent in irregular-shaped castings. Furthermore, the cylindrical nut includes a threaded bore so that the tension rod can be connected directly thereto. Because the shape of the loop portion of the lifting strap conforms very closely to the outer contour of the nut, deformation during lifting, and therefore undesirable elongation of the lifting assembly is avoided.

Specifically, the present invention is a bow or keel lift assembly for boats comprising: a rigid strap adapted to be mounted to the bow or keel of a boat and having an arcuate closed loop portion with a slot therein extending in the arcuate direction, a cylindrical nut rotatably received in the closed portion of the strap, a rigid rod passing through the slot with one end thereof being connected directly to the nut, a lifting-eye mounted to the deck of a boat, and means for connecting the other end of the rod to the lifting-eye. The strap includes a generally flat portion having a pair of apertures extending therethrough so as to accommodate mounting bolts or the like for the purpose of mounting the strap to the bow or keel of a boat. In a preferred form of the invention, the cylindrical nut has an internally threaded bore aligned with the strap slot into which the rod is threaded.

It is an object of the present invention to provide a bow or keel lift assembly of the solid rod type wherein the lift strap nut is regular in shape so that inherent weak points and stress faults are avoided.

Another object of the present invention is to provide a bow or keel lift assembly having a cylindrical nut rotatably received in a lift strap which closely conforms to the outer contour of the nut and is therefore not as susceptible to deformation as the prior art devices.

A further object of the present invention is to provide a bow or keel lift assembly wherein elongation during lifting is avoided so that all of the lifting force is transferred to the heavily reinforced parts of the boat such as the bow and keel and the possibility that a limited region of the boat deck will be excessively stressed is substantially eliminated.

A still further object of the present invention is to provide a bow or keel lift assembly for boats which is adjustable and easily adaptable to any boat design.

Yet another object of the present invention is to provide a bow or keel assembly which may be integrated with manufacturer installed bow-eyes.

These and other objects of the present invention will become more apparent upon reference to the detailed description taken in conjunction with the accompanying drawings.

DESCRIPTION OF THE PREFERRED EMBODIMENT

Figure 1:
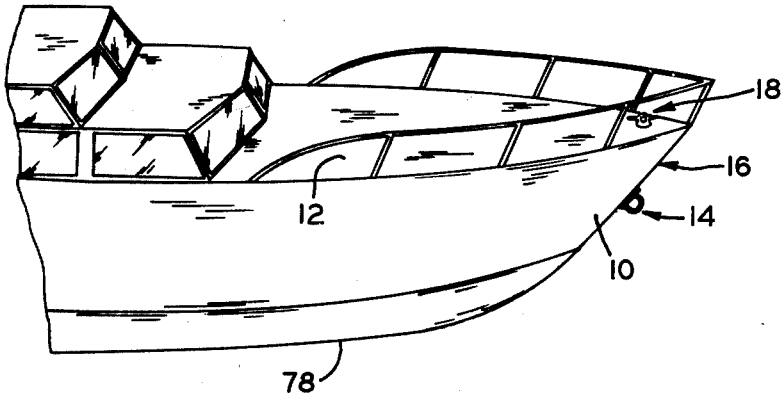
FIG. 1 is a fragmentary perspective view of a boat showing the lifting-eyes of a lift assembly according to the present invention on the forward portion of the deck and bow.

Referring now to the drawings, FIG. 1 shows a boat having a hull 10, an upper deck 12, a bow-eye 14 secured to the bow 16, and a lifting-eye 18 mounted to deck 12. Bow-eye 14 is generally for the purpose of towing the boat, although in some cases, fiberglass boats will be stored by suspending them in a vertical position from bow-eye 14. Lifting-eye 18 is for the purpose of lifting the boat in or out of the water.

Figure 2:
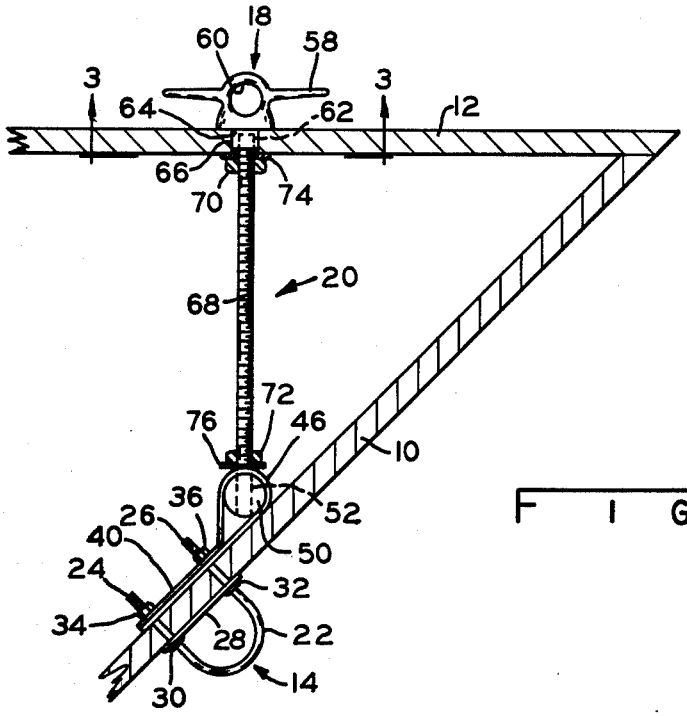
FIG. 2 is an enlarged fragmentary sectional view of the bow and deck showing the lift assembly of the present invention mounted thereto.
Figure 3:
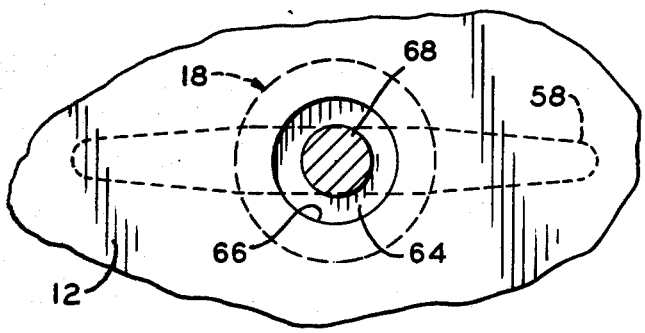
FIG. 3 is an enlarged sectional view taken along line 3—3 of FIG. 2 and viewed in the direction of the arrows.

FIG. 2 shows somewhat diagrammatically how the lifting assembly 20 according to the present invention, including bow-eye 14 and lifting-eye 18, is mounted in the bow portion of the boat shown in FIG. 1. Bow-eye 14 comprises a U-bolt 22 including threaded legs 24 and 26 which extend through hull 10 and plate 28, nuts 30 and 32 threaded on legs 24 and 26 against plate 28, and nuts 34 and 36, which are also threaded on legs 24 and 26 on the other side of hull 10. Nuts 30 and 32 preferably are circular with rounded outer corners so as to present an esthetically pleasing appearance and further are preferably bright plated for the sake of corrosion resistance and appearance.

Figure 4:
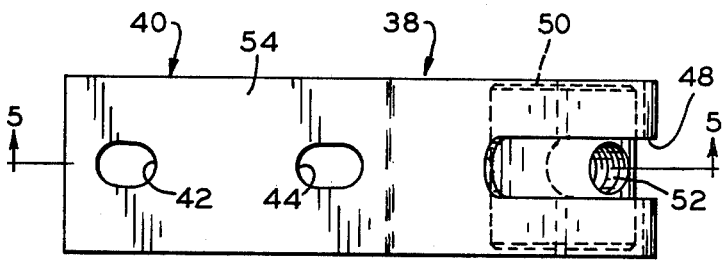
FIG. 4 is an enlarged plan view of the lifting strap and nut assembly according to the present invention.
Figure 5:
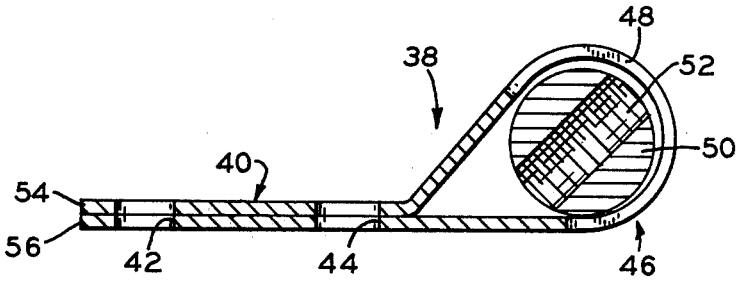
FIG. 5 is a sectional view of FIG. 4 taken along line 5—5 and viewed in the direction of the arrows.

The lifting strap 38 shown in detail in FIGS. 4 and 5 comprises a metal strip bent back on itself and including a substantially flat portion 40 having apertures 42 and 44 therethrough and a generally arcuate loop portion 46 having a slot 48 therein which extends at least partially around loop portion 46 as through an arc of 30°. Legs 24 and 26 of U-bolt 22 extend through apertures 42 and 44, respectively, and strap 38 is clamped between hull 10 and nuts 34 and 36 when the latter are tightened. Strap 38, like U-bolt 22, is preferably made of stainless steel or other suitable material having high strength properties and good corrosion resistance. A cylindrical nut 50 having an internally threaded bore 52 is by itself axially rotatably received within loop portion 46 through an arc of revolution subtending 360°, and, as best illustrated in FIG. 5, has very limited freedom of movement in any direction transverse to its longitudinal axis. This is important from the standpoint of limiting the amount of deformation of which loop portion 46 is capable when lifting stresses are applied thereto. Nut 50 is preferably made of stainless steel and has a uniform and regular shape so that weak points and stress faults are virtually eliminated. If desired, the overlapping layers 54 and 56 of portion 40 may be spot-welded together.

Lifting-eye 18 comprises a cleat 58 having an opening 60 therein and an internally threaded bore 62 in cylindrical portion 64 which extends through an opening 66 in deck 12. Lifting-eye 18 is preferably integral and made of stainless steel.

A rigid rod 68, which may either be threaded along its entire length as shown in FIG. 2 or, alternatively, threaded only at its ends, is threaded into the bore 52 of nut 50 and the bore 62 of ring 18 and adjusted such that there is a slight degree of tension between strap 38 and ring 18. The slot 48 in strap 38 permits rod 68 to be pivoted to the proper angle with respect to strap 38 so as to extend absolutely vertically between it and lifting-eye 18. Of course, the angle which rod 68 makes with respect to hull 10 will depend on the hull design of the particular boat in question. Lock nuts 70 and 72 and washers 74 and 76 serve to prevent rod 68 from turning.

When rod 68 is tensioned by drawing nut 50 and eye 18 together, all of the lifting force exerted on eye 18 when the boat is lifted will be transmitted directly to the bow portion of hull 10 which is heavily reinforced relative to deck 12. The close proximity of nut 36 to loop portion 46 tends to minimize any deformation of loop portion 46 when it is stressed by nut 50. If desired, rod 68 can be provided with right hand threads on one end and left hand threads on the other so that nut 50 and eye 18 may be drawn together by turning rod 68 in one direction or the other.

Figure 6:
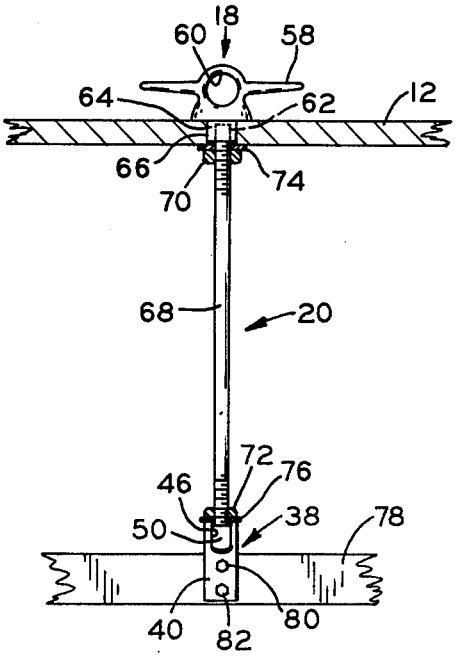
FIG. 6 is a sectional view of a boat deck and keel showing the lift assembly according to the present invention mounted thereto.

With reference now to FIG. 6, the manner of installing lifting assembly 20 between deck 12 and keel 78 is illustrated. In this case, strap 38 is turned 90° with respect to cleat 58 and bolted directly to keel 78 by bolts 80 and 82. With this arrangement, the lifting force on eye 18 is transmitted directly to keel 78, which is heavily reinforced and capable of withstanding the forces exerted when the boat is lifted.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the limits of the appended claims.

What is claimed is:

1. A lift assembly for boats comprising: a rigid strap mounted to the bow of a boat and having an arcuate closed loop portion with a slot in said loop portion extending in the arcuate direction, a cylindrical nut rotatably received in the closed loop portion of said strap, said nut having an internally threaded bore aligned with said slot, a rigid rod passing through said slot with one end of said rod being threaded into said bore, a lifting eye mounted to the deck of said boat, the other end of said rod being connected to said lifting eye, and a generally U-shaped eye member extending through the bow of the boat and being connected to said strap.

2. The lift assembly of claim 1 wherein said strap includes a generally flat portion including a pair of apertures adapted to accommodate mounting bolts or the like for the purpose of mounting said strap to the bow of the boat.

3. The lifting strap of claim 2 wherein said strap comprises a metal strip bent back on itself so as to form said loop portion and a flat portion adjacent said loop portion, said flat portion being formed by the overlapping end portions of the strips.

4. The lift assembly of claim 1 wherein said strap loop portion has an open internal configuration generally conforming to the shape of said nut.

5. The lift assembly of claim 1 wherein said loop portion has a teardrop shape.

6. The lift assembly of claim 1 wherein the other end of said rod is threaded to said lifting eye.

* * * * *